340-552

9/23/80 OR 4,224,607

United States Patent [19]

Poirier et al.

[11] 4,224,607

[45] Sep. 23, 1980

[54] INTRUDER DETECTOR SYSTEM HAVING IMPROVED UNIFORMITY OF DETECTION SENSITIVITY

[75] Inventors: J. Leon Poirier, Chelmsford; Kotcherlakota V. N. Rao, Bedford; Livio D. Poles, Dorchester, all of Mass.

[73] Assignee: The United States of America as represented by the Secretary of the Air Force, Washington, D.C.

[21] Appl. No.: 52,178

[22] Filed: Jun. 25, 1979

[51] Int. Cl.[2] ..... G08B 13/18

[52] U.S. Cl. ..... 340/552; 333/237; 393/771

[58] Field of Search ..... 340/552, 541; 393/771; 333/237

[56] References Cited

U.S. PATENT DOCUMENTS

| | | | |
|---|---|---|---|
| 3,794,992 | 2/1974 | Gehman | 340/552 |
| 3,806,908 | 4/1974 | Bound et al. | 340/566 |
| 4,135,185 | 1/1979 | Rotman et al. | 340/552 |

*Primary Examiner*—Glen R. Swann, III

*Attorney, Agent, or Firm*—Joseph E. Rusz; Willard R. Matthews, Jr.

[57] ABSTRACT

Uniform detection sensitivity along the periphery of an r.f. loop intruder detector system is realized by periodically electronically interchanging the input and termination ends of the system's leaky transmission line transmitting element. The intruder detector system comprises a length of leaky transmission line that encompasses the region to be protected, a receiving antenna within the protected region, an r.f. transmitter and a remotely located receiver and detector. R.F. energy is transmitted through the leaky transmission line and received by the receiving antenna and detector means to establish a normally quiescent field. Violation of the protected region by crossing the leaky transmission line disturbs the quiescent field condition and the intrusion event and the location is signaled by the detector. The effects of attenuation along the leaky transmission line are obviated by periodically switching the transmitter to alternate leaky transmission line ends. Switching of the transmitters is accomplished by solid state, mechanical, r.f. and other switching means.

4 Claims, 8 Drawing Figures

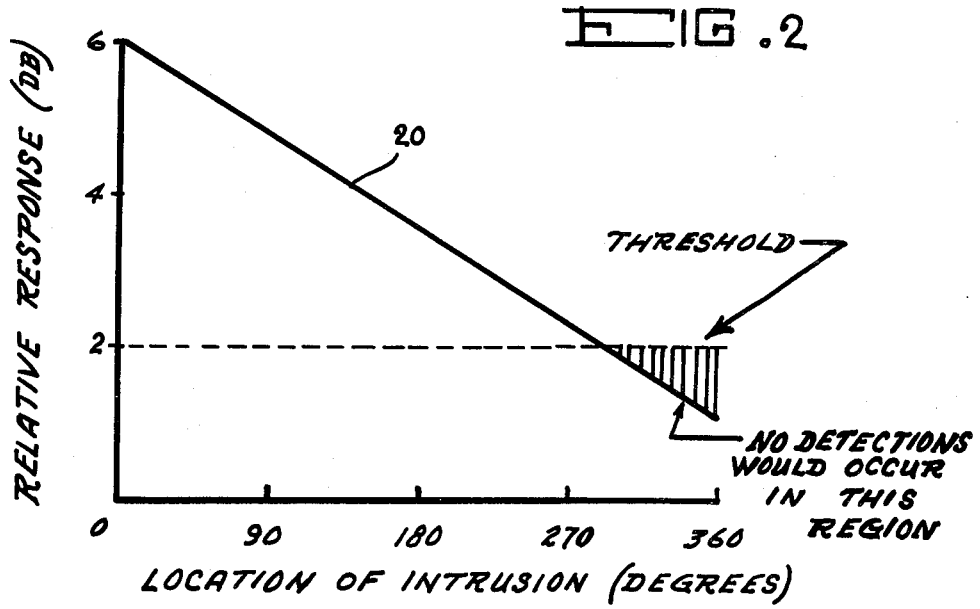
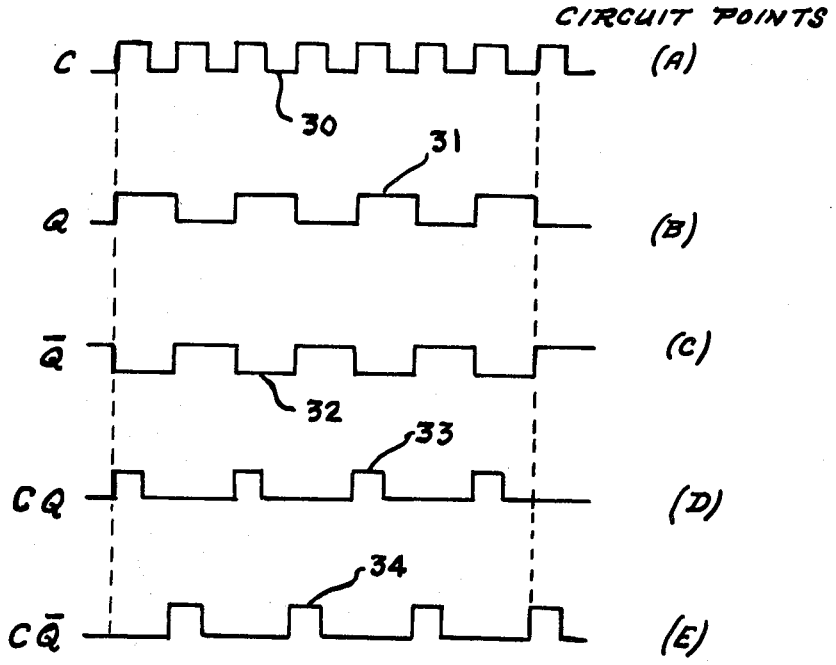
FIG. 4

FIG. 5
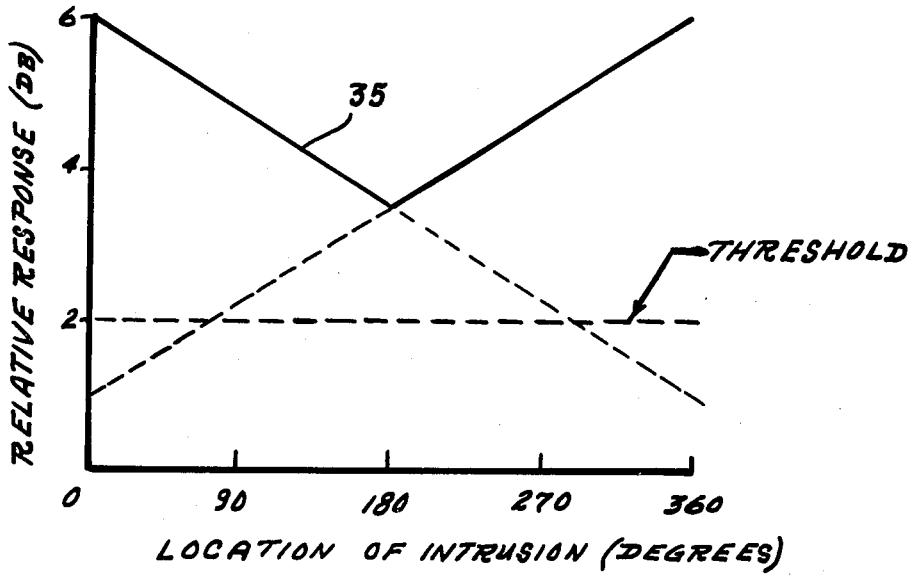
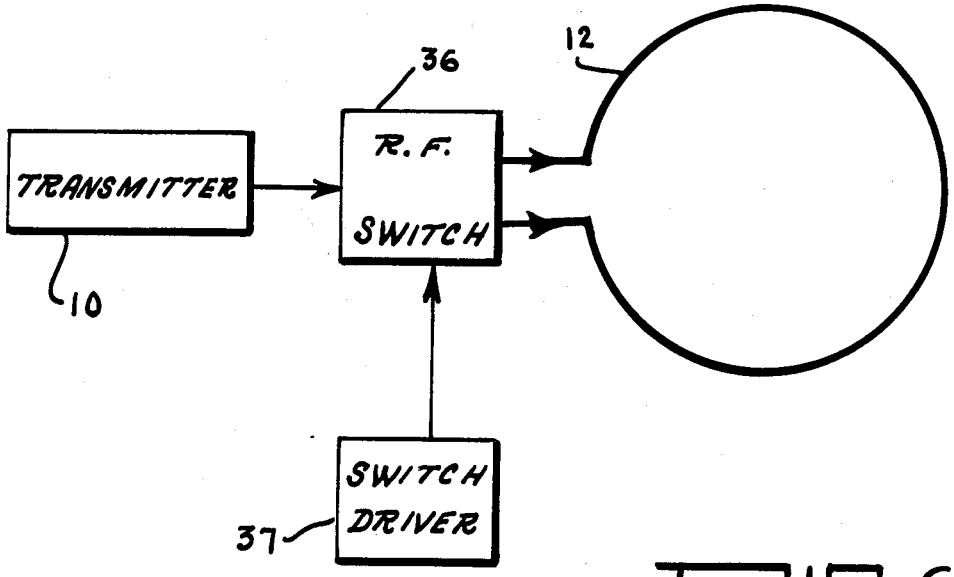
FIG. 6

FIG. 7
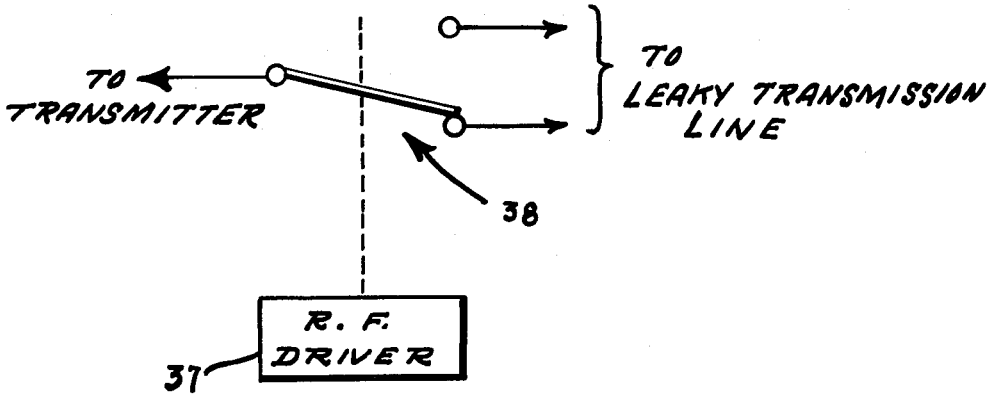
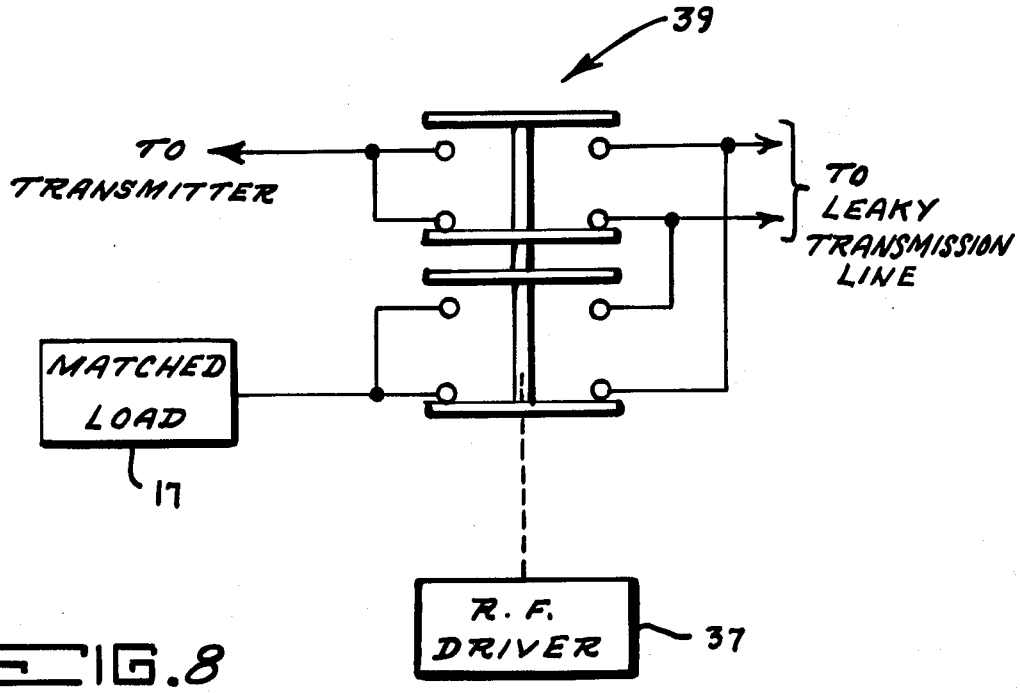
FIG. 8

INTRUDER DETECTOR SYSTEM HAVING IMPROVED UNIFORMITY OF DETECTION SENSITIVITY

STATEMENT OF GOVERNMENT INTEREST

The invention described herein may be manufactured and used by or for the Government for governmental purposes without the payment of any royalty thereon.

BACKGROUND OF THE INVENTION

This invention relates to R.F. loop intrusion detection systems and in particular to means for improving the uniformity of detection sensitivity around the signal of radiating loop of such a system.

The R.F. Loop intruder Detection System consists of a loop of leaky coaxial cable which encircles the resource to be protected and acts as a distributed transmitting (or receiving) antenna. One or more monopole antennas located near the center of the loop act as receiving (or transmitting) elements. When an intruder crosses the leaky coax cable, he modifies the quiescent field conditions thereby producing a change in the received signal strength which is detected.

In the type of system to which the invention applies, the transmitter is connected to one end of the leaky coax cable and a matched load at the other. To protect a large aircraft, up to one thousand feet of leaky coaxial cable are required. However, because of the attenuation of the leaky coakial cable, the signal radiated from the far end of the cable is considerably less than that near the input end. Differences of ten decibles are typical. As a result, the detection sensitivity near the input end of the leaky cable sensor is greater than that near the termination end. This results in intrusion events at the far end of the loop going undetected. Increasing the sensitivity of the loop to ensure detection of intrusion at the far end has the effect of making the near end too sensitive resulting in false and nuisance alarms. Accordingly, there currently exists the need for means whereby R.F. loop intrusion detection systems can be made to exhibit adequate and substantially uniform detection sensitivity along the full length of the leaky transmission line loop. The present invention is directed toward meeting that need.

SUMMARY OF THE INVENTION

The invention is an intrusion detection system comprising a leaky transmission line loop encompassing a protected region, an r.f. transmitter, an antenna located within the protected region, receiver and detector means connected to the antenna and switching means for periodically switching the r.f. transmitter from one end to the other of the transmission line loop. In one embodiment a matched load is provided for the transmission line loop that is also alternately switched with the r.f. transmitter to opposite ends of the line. Various switching schemes including solid state, mechanical and r.f. switches and logic circuits are comprehended for actuating the system.

It is a principal object of the invention to provide a new and improved intruder detection system.

It is another object of the invention to provide an r.f. loop intrusion detection system having adequate and substantially uniform detection sensitivity along the full length of the r.f. transmitting loop.

It is another object of the invention to provide an r.f. loop intrusion detection system in which the r.f. transmitter is alternately switched to opposite ends of the r.f. transmitting loop.

These, together with other objects, features and advantages of the invention will become more readily apparent from the following detailed description when taken in conjunction with the illustrative embodiments in the accompanying drawings.

DESCRIPTION OF THE DRAWINGS

FIG. 2 is a response curve representing a typical response of the system of FIG. 1 to an intruder;

FIG. 4 illustrates the waveforms of FIG. 3 for control of feed switching;

FIG. 5 is a response curve representing the improved system response of the present invention;

FIG. 6 is a block diagram system layout for implementation with R.F. switching;

FIG. 7 is a schematic illustration of a SPST switch for use in the R.F. switching scheme of FIG. 5; and, FIG. 8 is a schematic illustration of a DPDT switch for use in the R.F. switching scheme of FIG. 6 and including a matched load.

DETAILED DESCRIPTION OF THE PREFERRED EMBODIMENT

Figure 1:
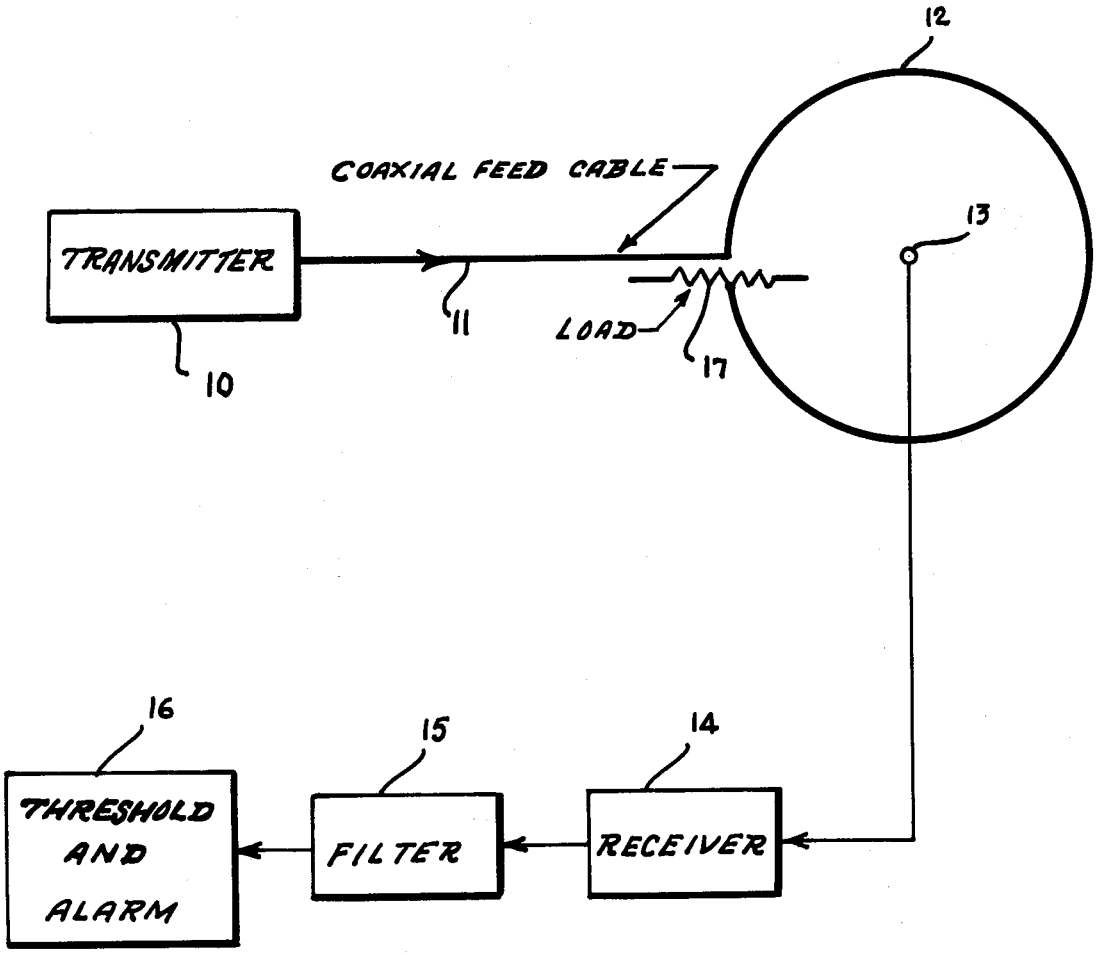
PRIOR ART FIG. 1
FIG. 1 is a block diagram of an R.F. loop intruder detection system.

A simplified block diagram of an intrusion detection system of the type to which the present invention applies is shown in FIG. 1. It comprises r.f. transmitter 10, feed cable 11, leaky transmission line 12 (conveniently an apertured coaxial cable), antenna means 13, matched load 17, receiver 14, filter 15 and threshold and alarm circuit 16.

In operation, the transmitter 10 feeds one end of the leaky coaxial cable 12 which acts as a distributed transmitting antenna. The other end is terminated with a matched load 17. One or more centrally located antennas 13, usually quarter-wavelength monopoles, act as receiving elements. The received signal changes from its steady state value when an intruder crosses the leaky coax sensor cable. The bandpass filter 15 passes only those signal variations that correspond to human frame motion. The thresholding and alarm circuits 16 which require a minimum amplitude change in the received signal before activation serve to prevent false alarms or nuisence alarms.

A typical detection sensitivity curve 20, is shown in FIG. 2 for this system. There is a gradual decrease in response as the point of intrusion is moved away from the transmitter end of the cable. This decrease in response is caused by the attenuation in the leaky coaxial cable. As the signal propagates inside the leaky coax, its amplitude gradually decreases and less signal is radiated from successive points along the leaky cable. At 75 MHZ, an attenuation of 10–20dB for one thousand feet of cable is typical.

As a consequence of this, the response at the far end of the system may be insufficient to trigger the alarm. If the system sensitivity is increased to guarantee detection at the far end, then the near end is too sensitive and can produce false or nuisance alarms.

The present invention provides a method of counteracting the gradual decrease in detection sensitivity produced by cable attenuation. The technique consists of periodically connecting the transmitter to alternate ends of the leaky coaxial cable so that the resulting response will be more uniform.

Figure 3:
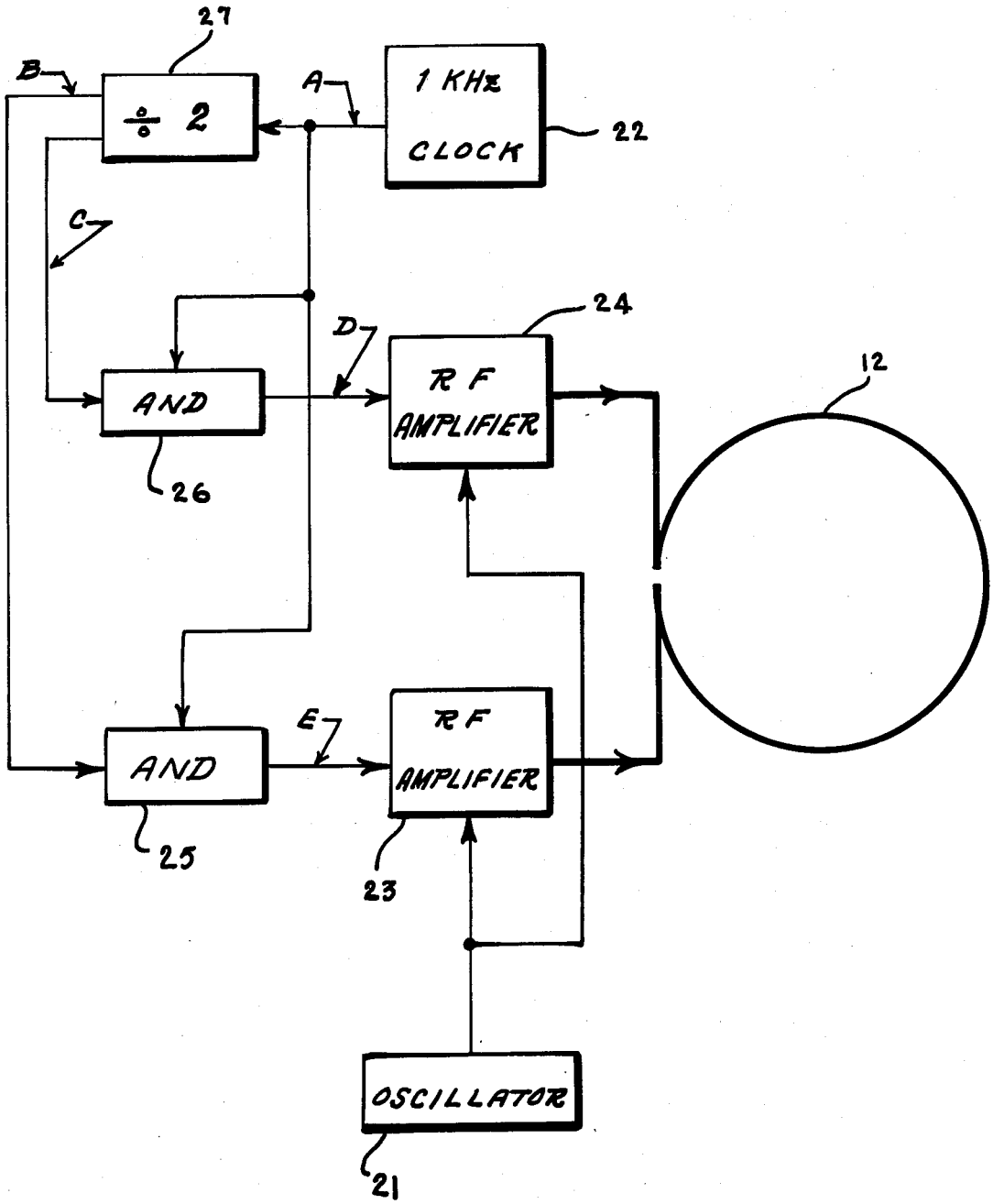
FIG. 3 is a block diagram of one switching scheme comprehended by the invention.

There are many ways to implement the technique. What is required is a method of switching the transmitter (or receiver) from one end of the cable to the other. A solid state or mechanical switch might be appropriate in some instances. Another implementation is shown in FIG. 3. This circuit comprises oscillator 21, clock 22, amplifiers 23, 24, divider 27, and AND gates 25, 26 arranged as shown. Here advantage is taken or the 1 KHz modulating square wave already present in the existing system. By dividing its frequency by two and combining these outputs with the original waveform in AND logic, two new modulating waveforms are generated. These two waveforms alternately turn the r.f. amplifiers on and off so that only one end of the cable at a time is energized. The effective modulating frequcency remains 1 KHz. The waveforms associated with the circuit are shown as waveforms 30–34 in FIG. 4. The new response represented by the solid line 35 in FIG. 5 clearly shows the improvement in system performance. Now no segment of the sensor cable produces a response below the detection threshold.

An alternate implementation which uses an r.f. switch 36 and switch driver 37 at the cable input is shown in FIG. 6. If the switch is an SPST device, the distributed attenuation of the cable will provide the loading for the unconnected end. A DPDT device would result in better performance since the unconnected end of the cable could then be terminated in a matched load. FIG. 7 illustrates schematically a SPST switch 38 and FIG. 8 illustrates schematically a DPDT switch 39, each being suitable for use in the present invention.

While the invention has been described in its preferred embodiment, it is understood that the words which have been used are words of description rather than words of limitation and that changes within the purview of the appended claims may be made without departing from the scope and spirit of the invention in its broader aspects.

What is claimed is:

1. An intruder detector system comprising a length of leaky transmission line encompassing a region to be protected, antenna means within said region to be protected, an r.f. receiver and detector means connected to said antenna means, an r.f. transmitter, and switching means, said switching means periodically connecting said r.f. transmitter to alternate ends of said leaky transmission line.

2. An intruder detector system as defined in claim 1 wherein said switching means comprises an r.f. single pole single throw switch.

3. An intruder detector system as defined in claim 1 including a load matched to said leaky transmission line and connected to said leaky transmission line on the end opposite said transmitter and wherein said switching means comprises an r.f. double pole double throw switch arranged to periodically connect said transmitter and said load to alternate ends of said leaky transmission line.

4. An intruder detector system as defined in claim 1 wherein said switching means comprises a first r.f. amplifier connected to one end of said leaky transmission line, a second r.f. amplifier connected to the other end of said leaky transmission line, said r.f. transmitter driving said first and second amplifiers, clock means generating a clock signal, divider means for halving said clock signal, to provide two pulse trains at half the frequency of said clock signal, said two pulse trains being 180 degrees out of phase with one another, a first AND gate having first and second inputs and an output, said clock signal being fed to said first input, one of said pulse trains being fed to said second input and said output being connected to said first r.f. amplifier, and a second AND gate having first and second inputs and an ouptut, said clock signal being fed to said first input, the other of said pulse trains being fed to said second input and said output being connected to said second r.f. amplifier.

* * * * *